US008403540B2

(12) United States Patent
Cheng et al.

(10) Patent No.: US 8,403,540 B2
(45) Date of Patent: Mar. 26, 2013

(54) LIGHTING DEVICE

(75) Inventors: Chin-Yuan Cheng, Taipei Hsien (TW); Hong-Long Chen, Taipei Hsien (TW)

(73) Assignee: Kwo Ger Metal Technology, Inc., Taipei Hsien (TW)

( * ) Notice: Subject to any disclaimer, the term of this patent is extended or adjusted under 35 U.S.C. 154(b) by 434 days.

(21) Appl. No.: 12/840,628

(22) Filed: Jul. 21, 2010

(65) Prior Publication Data

US 2011/0080743 A1 Apr. 7, 2011

(30) Foreign Application Priority Data

Oct. 1, 2009 (TW) ..... 98218162 U

(51) Int. Cl.
*F21V 17/00* (2006.01)

(52) U.S. Cl. ..... 362/341; 362/346; 362/326

(58) Field of Classification Search ..... 362/326, 362/328, 341, 346, 360
See application file for complete search history.

(56) References Cited

U.S. PATENT DOCUMENTS 1,692,612 A * 11/1928 Bennington ..... 116/200
7,403,680 B2 * 7/2008 Simbal ..... 385/31

* cited by examiner

*Primary Examiner* — Vip Patel
(74) *Attorney, Agent, or Firm* — Muncy, Geissler, Olds & Lowe, PLLC

(57) ABSTRACT

A lighting device includes a housing, and a light-emitting module mounted in an accommodation chamber inside the housing and carrying a set of light-emitting devices on a circuit board thereof for emitting light, a plurality of refracting prisms for refracting a part of the light emitted by the light-emitting devices horizontally toward two opposing sides through the light transmissive peripheral wall of the top cover shell of the housing and two opposing double-beveled reflectors for reflecting the other part of the light emitted by the light-emitting devices toward the outside through the light transmissive peripheral wall of the top cover shell of the housing in the same opposing directions. Thus, the invention extends the luminous range of the light-emitting devices, enhances the luminance and reduces light loss.

12 Claims, 7 Drawing Sheets

LIGHTING DEVICE

This application claims the priority benefit of Taiwan patent application number 098218162, filed on Oct. 1, 2009.

BACKGROUND OF THE INVENTION

1. Field of the Invention

The present invention relates to lighting technology and more particularly, to a lighting device, which extends the luminous range of the light-emitting devices thereof, enhances the luminance and reduce light loss.

2. Description of the Related Art

The invention of lamp changes the living style of human beings, enabling people to work at night. Nowadays, many different types of lamps have been created for different applications, for example, fluorescent lamps, desk lamps, wall lamps and ceiling lamps for indoor lighting, street lights for outdoor lighting and signal lights for traffic guide and warning applications. Regular outdoor lights commonly emit light through 360° angle. During operation, the light intensity reduces gradually in all directions from the center area toward the distal area, shortening the luminous range. Thus, the number of lamps must be relatively increased to maintain the desired brightness in all areas. However, increasing the number of lamps relatively increases the installation cost and power consumption. Nowadays, in view of the world trend of energy-saving and carbon-reduction, power-saving bulbs and LEDs (light emitting diodes) are intensively used to substitute for conventional lamp bulbs or lamp tubes. However, conventional lighting devices, either for indoor application or outdoor application, still have numerous drawbacks as follows:

1. In consideration of the limited luminous range of conventional street lights, the installation interval must be shortened to maintain the desired luminance; however increasing the number of street lights relatively increases the consumption of power supply.

2. Due to the drawback of limited luminous range of conventional indoor lighting devices, the number of lighting devices in an indoor space must be relatively increased to maintain the desired luminance; however increasing the number of indoor lighting devices relatively increases the installation cost and the consumption of power supply.

3. Due to the limitation that the luminous area of conventional indoor lighting devices and outdoor lighting devices is a circular area, the brightness in the circular luminous area is not uniform, lowering the effect of illumination.

Therefore, it is desirable to provide a lighting device, which eliminates the aforesaid problems.

SUMMARY OF THE INVENTION

The present invention has been accomplished under the circumstances in view. It is the main object of the present invention to provide a lighting device, which extends the luminous range of the light-emitting devices thereof, enhances the luminance and reduce light loss.

To achieve this and other objects of the present invention, a lighting device comprises a housing defining an accommodation chamber, and a light-emitting module mounted in the accommodation chamber inside the housing. The light-emitting module comprises a circuit board carrying a plurality of light-emitting devices, a plurality of refracting prisms adapted to refract a part of the light emitted by the light-emitting devices horizontally toward two opposing sides through the light transmissive peripheral wall of the top cover shell of the housing, and two opposing double-beveled reflectors adapted to reflect the other part of the light emitted by the light-emitting devices toward the outside through the light transmissive peripheral wall of the top cover shell of the housing in the same opposing directions. Thus, the invention extends the luminous range of the light-emitting devices, enhances the luminance and reduces light loss.

Further, the two double-beveled reflectors are arranged at two opposing sides relative to the light-emitting devices and the refracting prisms and aimed at each other, each double-beveled reflector having a double-beveled structure formed of two vertically extending reflecting surfaces that meet at a vertex. Each refracting prism has a 10~45° angle included between two sides thereof through which the refracted beam passes.

Further, the two vertically extending reflecting surfaces of each double-beveled reflector define an included angle. In one example of the present invention, the two vertically extending reflecting surfaces of one double-beveled reflector define an included angle within the range of 10°~140°, and the two vertically extending reflecting surfaces of the other double-beveled reflector define an included angle within the range of 40°~80°. In another example of the present invention the two vertically extending reflecting surfaces of each double-beveled reflector define an included angle within the range of 100°~140°. In still another example of the present invention the two vertically extending reflecting surfaces of each double-beveled reflector define an included angle within the range of 40°~80°.

DETAILED DESCRIPTION OF THE PREFERRED EMBODIMENT

Figure 1:
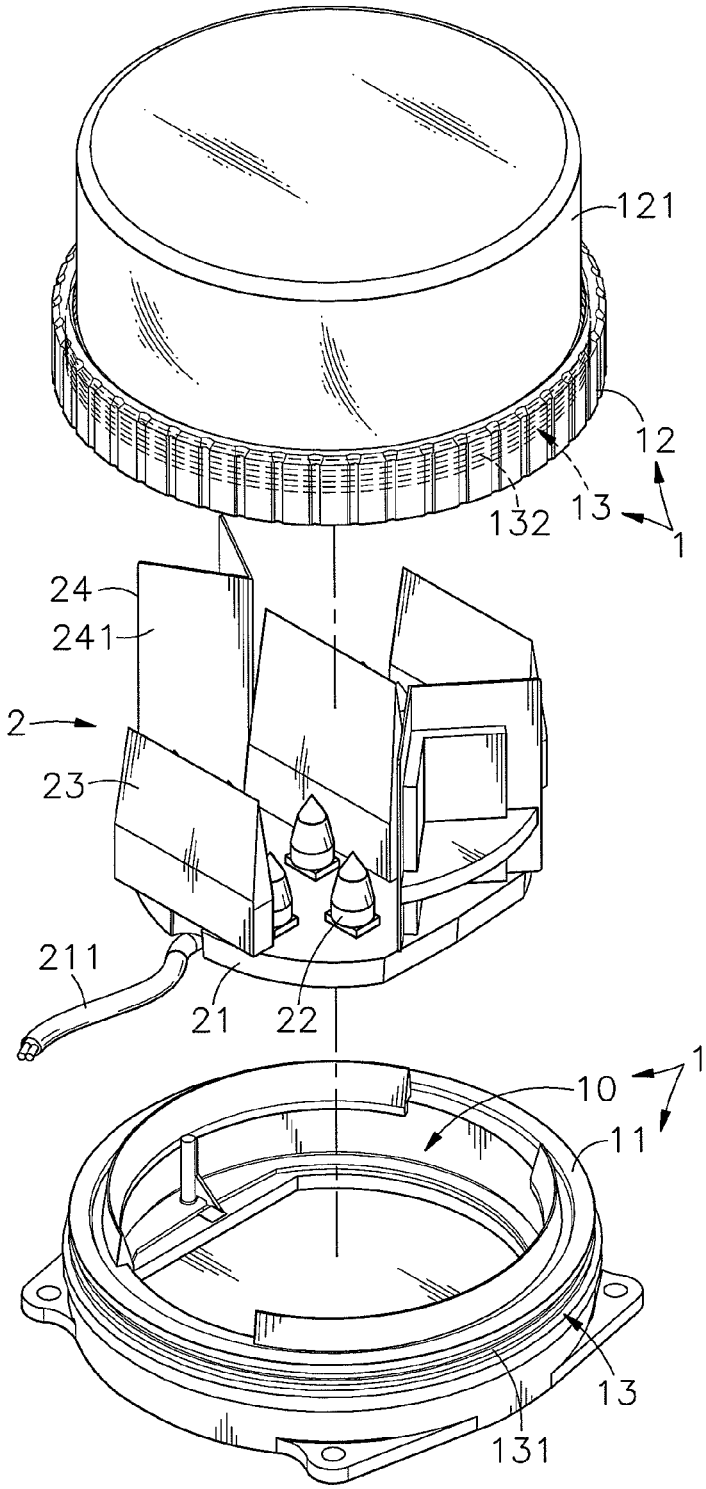
FIG. 1 is an explode view of a lighting device in accordance with the present invention.
Figure 2:
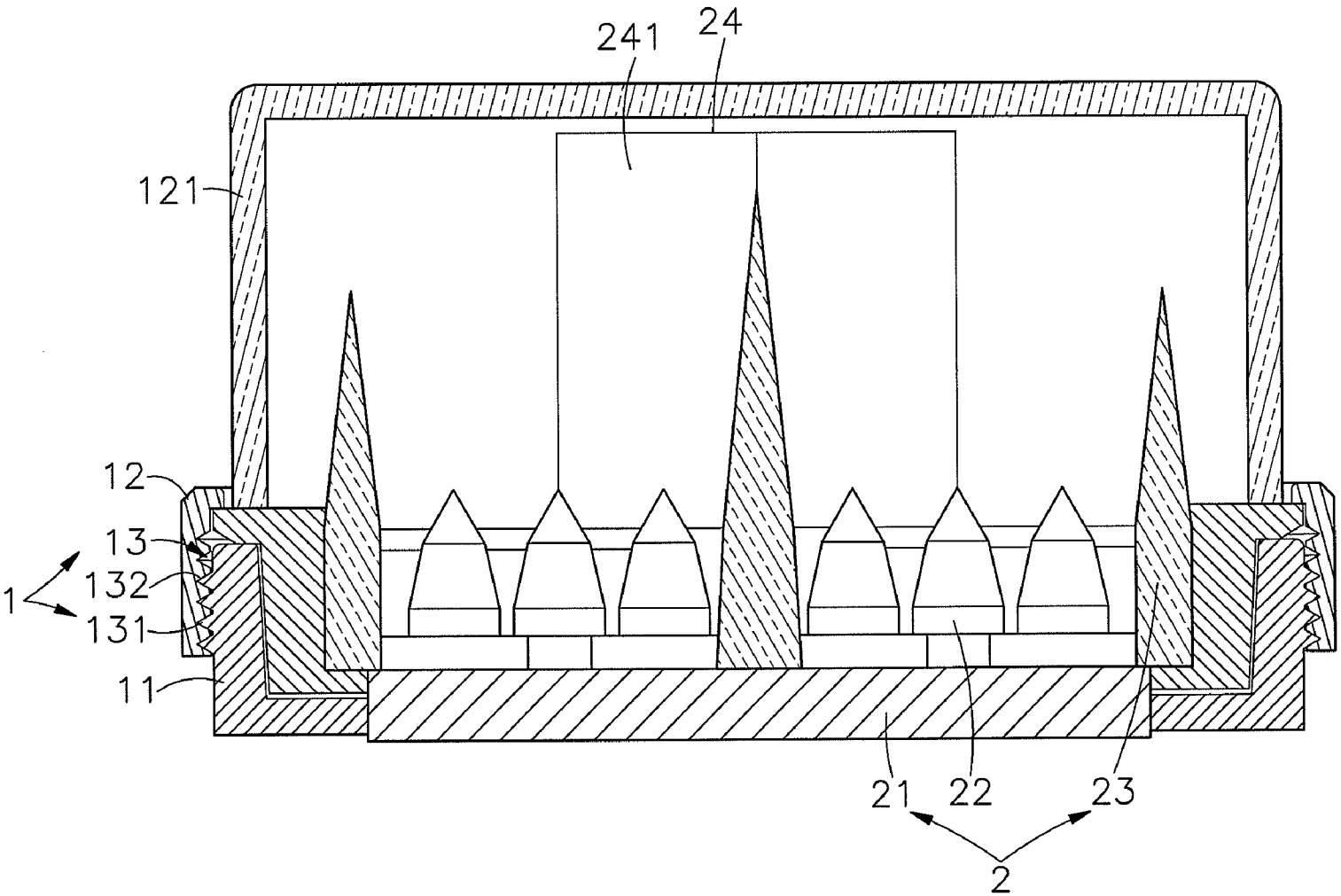
FIG. 2 is a sectional side view of the lighting device in accordance with the present invention.
Figure 3:
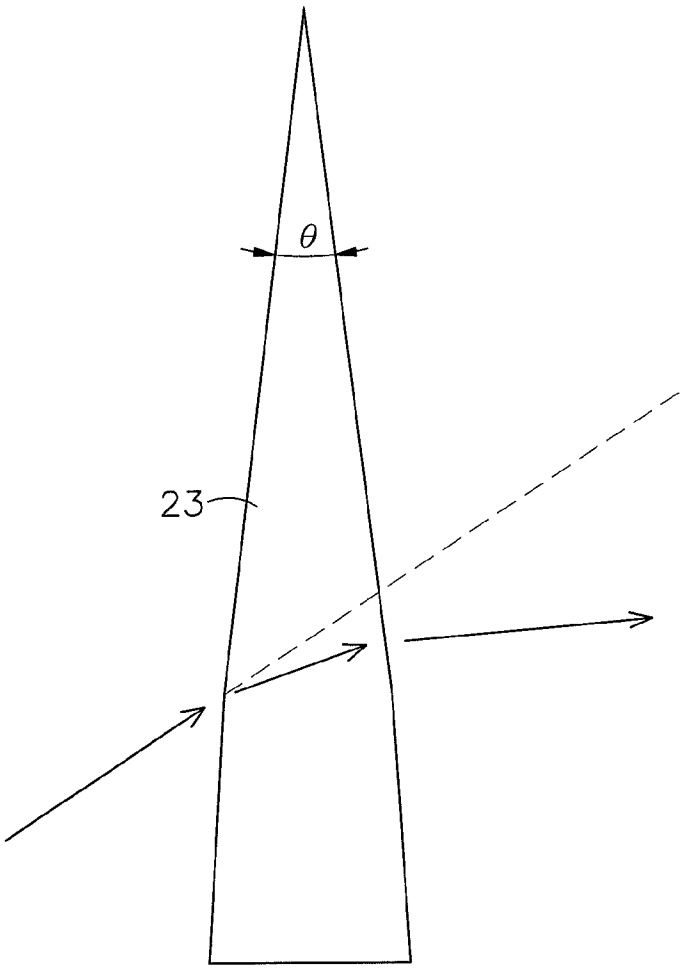
FIG. 3 is a schematic drawing showing refraction operation of one refracting prism according to the present invention.
Figure 4:
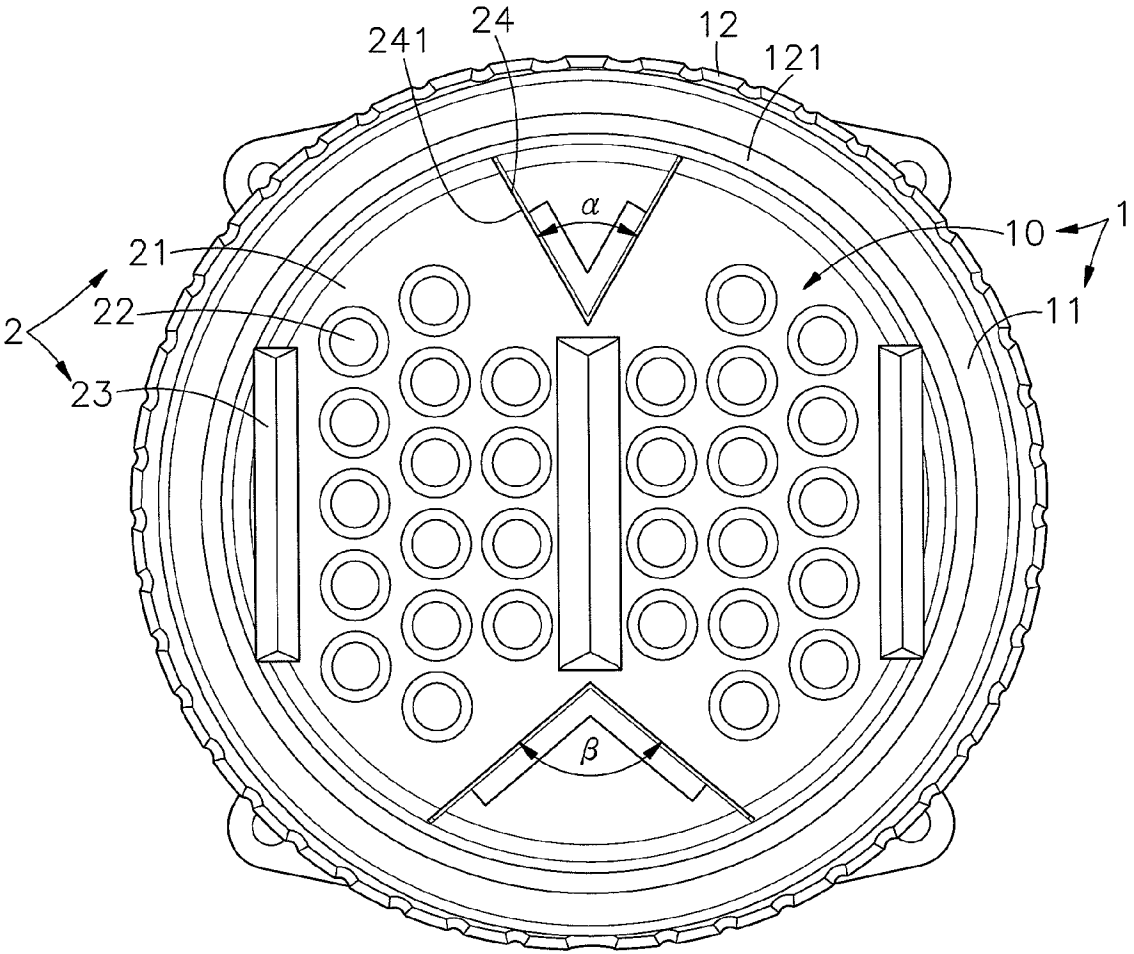
FIG. 4 is a top view of the lighting device in accordance with the present invention.

Referring to FIGS. 1~4, a lighting device in accordance with the present invention is shown comprising a housing 1 and a light-emitting module 2.

The housing 1 is formed of a bottom shell 11 and a top cover shell 12. The bottom shell 11 and the top cover shell 12 define therein an accommodation chamber 10. The top cover shell 12 has a light transmissive peripheral wall 121 extending around the accommodation chamber 10. By means of a mounting structure 13, the bottom shell 11 and a top cover shell 12 are fastened together.

The light-emitting module 2 comprises a circuit board 21 carrying a circuit layout, a power source 211 electrically connected to the circuit board 21, a plurality of light-emitting devices 22 installed in the circuit board 21, a plurality of refracting members, for example, refracting prisms 23 mounted on the circuit board 21 for refracting the light emitted by the light-emitting devices 22 and adapted to refract the light emitted by the light-emitting devices 22 in predetermined directions, and two double-beveled reflectors 24 arranged at two opposing sides relative to the refracting prisms 23 and aimed at each other and adapted to reflect the light emitted by the light-emitting devices 22 in the same predetermined directions. Each double-beveled reflector 24 has a double-beveled structure formed of two vertically extending reflecting surfaces 241 that meet at a vertex.

During installation, the light-emitting module 2 is mounted in the accommodation chamber 10 inside the bottom shell 11 and top cover shell 12 of the housing 1. The power source 211 provides the circuit board 21 and the light-emitting devices 22 with the necessary working power so that the light-emitting devices 22 can be controlled to emit light toward the refracting prisms 23 and the vertically extending reflecting surfaces 241 of the double-beveled reflectors 24, enabling the emitted light to be refracted and/or reflected toward the outside through the light transmissive peripheral wall 121 of the top cover shell 12 in the predetermined directions.

Further, the housing 1 can be made in any of a variety of shapes so that the lighting device can be used as a signal light, desk lamp, searchlight, ceiling light or vehicle light. According to the present preferred embodiment, the housing 1 is formed of the bottom shell 11 and top cover shell 12 that are fastened together by means of a mounting structure 13. The mounting structure 13 according to the present preferred embodiment comprises an outer thread 131 located on the bottom shell 11, and an inner thread 132 located on the top cover shell 12 for threading into the outer thread 131. Snap joint, screws, rivets, pins and any of a variety of other fastening members or joints may be selectively used for enabling the bottom shell 11 and the top cover shell 12 to be fastened together. Further, as an alternate form of the present invention, the housing 1 can be a single-piece design. Further, the light transmissive peripheral wall 121 of the top cover shell 12 can be prepared from a transparent or translucent material, having a gloss surface, semi-gloss surface, frosted surface, semi-frosted surface, fine sanded surface, or multilayer surface structure.

Further, the power source 211 of the light-emitting module 2 can be a dry battery, storage battery, rechargeable battery, AC power adapter or power generator capable of providing the necessary working voltage to the circuit board 21 and the light-emitting devices 22. The light-emitting devices 22 can be light-emitting diodes, organic light-emitting diodes, lamp bulbs or xenon bulbs adapted to emit light when electrically connected. Further, according to the present preferred embodiment, the light-emitting devices 22 are arranged into two sets; the number of the refracting prisms 23 is 3, i.e., one refracting prism 23 is located on the middle between the two sets of light-emitting devices 22 and the other two refracting prisms 23 are arranged at two opposing sides relative to the two sets of light-emitting devices 22. Further, the refracting prisms 23 are triangular prisms, each having a 10~45° angle $\theta$ included between two sides thereof through which the refracted beam passes. Further, the double-beveled reflectors 24 arranged at two opposing sides relative to the refracting prisms 23 and aimed at each other and adapted to reflect the light emitted by the light-emitting devices 22 in the same predetermined directions. Further, the included angle $\alpha$ defined by the two vertically extending reflecting surfaces 241 of one of the two double-beveled reflectors 24 and the included angle $\beta$ defined by the two vertically extending reflecting surfaces 241 of the other double-beveled reflector 24 can be the same. Alternatively, the included angles $\alpha$ and $\beta$ can be different. Preferably, the included angle $\beta$ of one double-beveled reflector 24 is within the range of 100°~140°, and the included angle $\beta$ of the other double-beveled reflector 24 is within the range of 40°~80°. In the case where $\alpha$ and $\beta$ are equal, the included angle can be within the range of 100°~140°, or the range of 40°~80°. Thus, the reflecting surfaces 241 of the double-beveled reflectors 24 effectively reflect the light emitted by the light-emitting devices 22 and/or the light refracted by the refracting prisms 23 toward the outside of the housing 1 through the light transmissive peripheral wall 121 of the top cover shell 12 in the predetermined directions.

Figure 5:
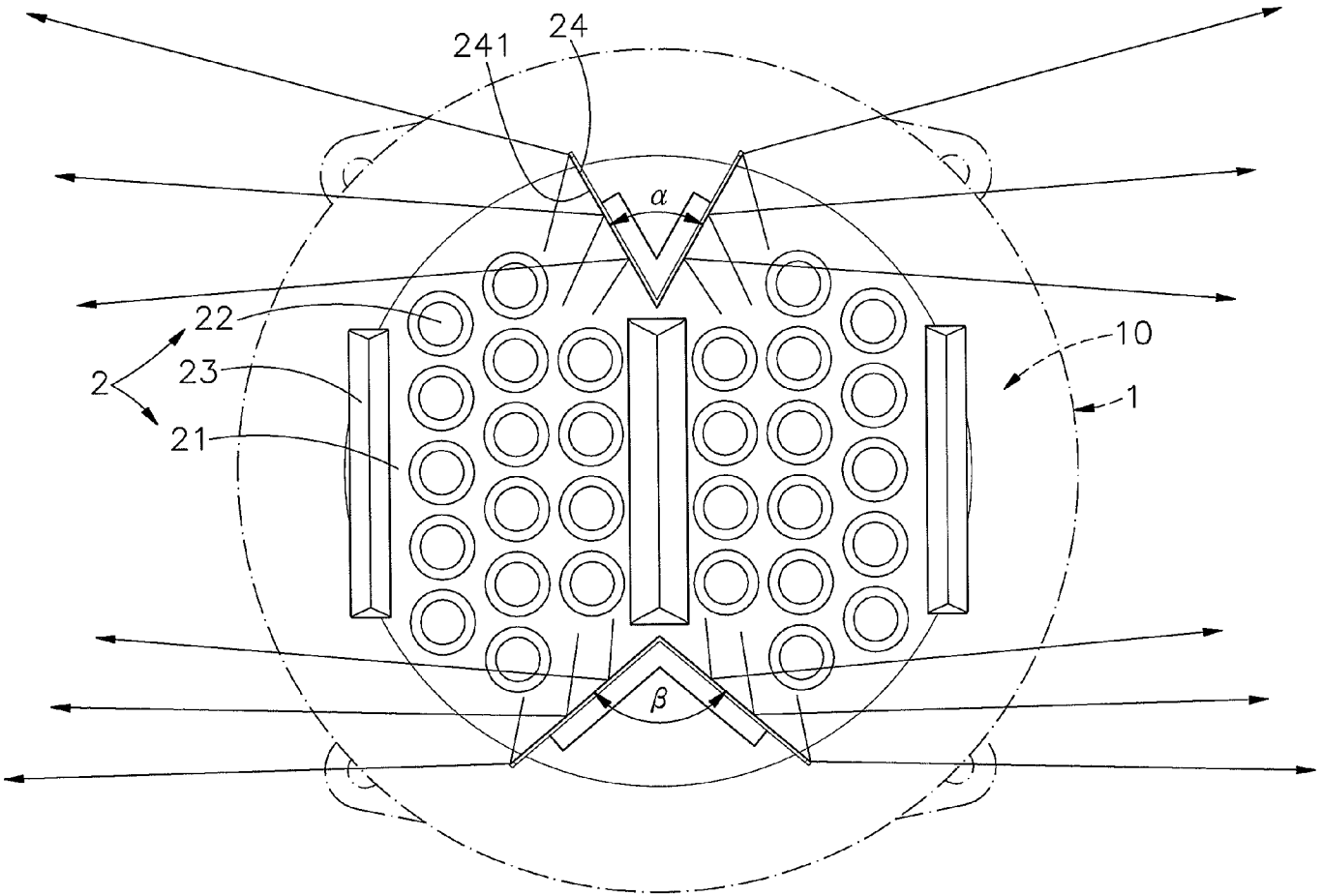
FIG. 5 is a schematic top view of the present invention, showing the directions of light rays reflected by the vertically extending reflecting surfaces of the double-beveled reflectors.
Figure 6:
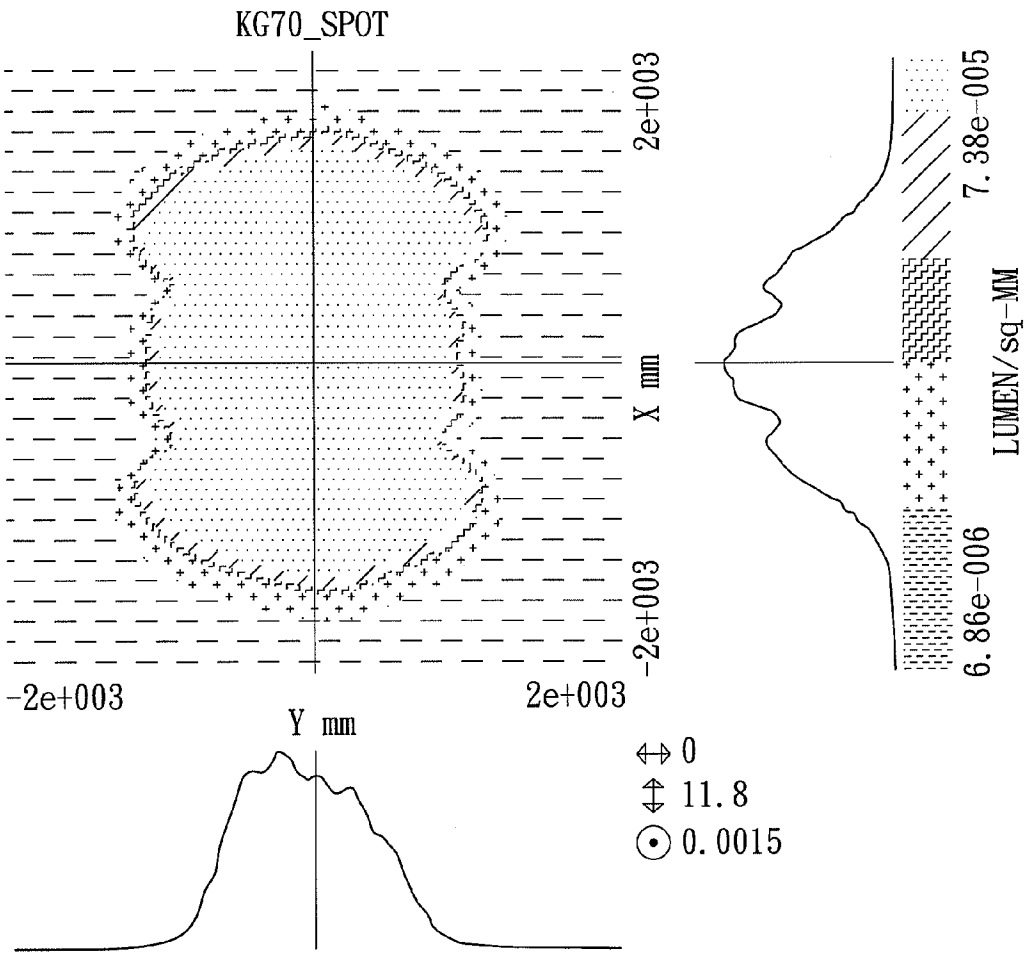
FIG. 6 is a diagram showing the projection range of lighting device in accordance with the present invention.
Figure 7:
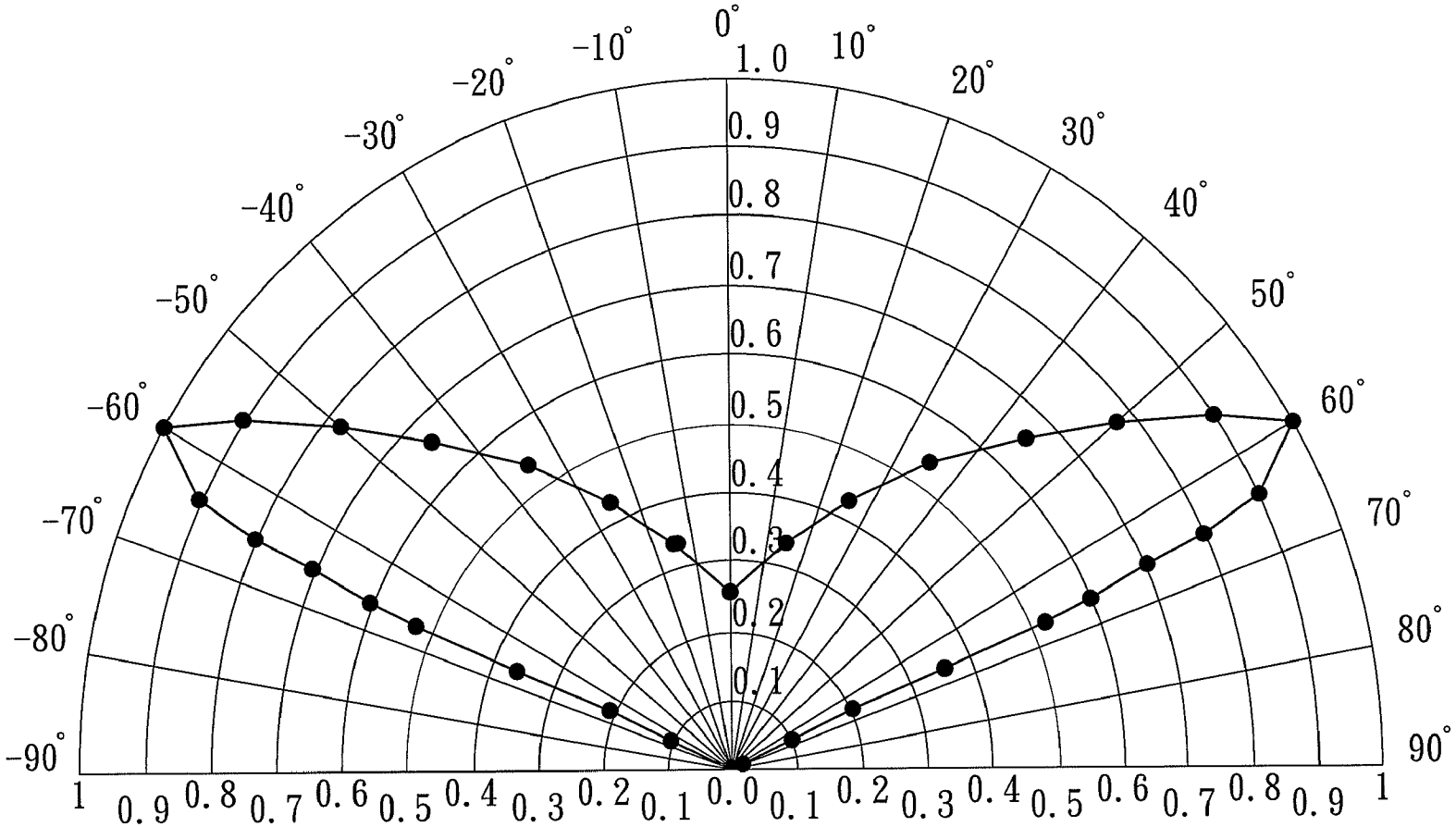
FIG. 7 is a diagram showing the projection angle of lighting device in accordance with the present invention

Referring to FIGS. 5~7 and FIG. 1 again, when electricity is being transmitted from the power source 211 (dry battery, storage battery, rechargeable battery, AC power adapter or power generator) of the light-emitting module 2 to the circuit board 21 and the light-emitting devices 22, the light-emitting devices 22 are driven to emit light. At this time, a part of the light emitted by the light-emitting devices 22 is refracted by the refracting prisms 23 horizontally toward two opposing sides through the light transmissive peripheral wall 121 of the top cover shell 12, and the other part of the light emitted by the light-emitting devices 22 is reflected by the vertically extending reflecting surfaces 241 of the double-beveled reflectors 24 toward the outside through the light transmissive peripheral wall 121 of the top cover shell 12 in the same opposing directions, extending the luminous range of the light-emitting devices 22, enhancing the luminance and reducing light loss.

Subject to the use of the refracting prisms 23 and the double-beveled reflectors 24 to extend the luminous range of the light-emitting devices 22 and to enhance its luminance, the invention is practical for street lighting as well as indoor lighting. When the invention is used for street lighting, the advantage of extending the luminous range allows reasonable increase of the installation interval. If the invention is used for indoor lighting, the number of lamps in every unit space can be relatively reduced while maintaining excellent luminance, saving lamp installation cost and power consumption.

The embodiment described above is simply an exemplar of the present invention and not intended as a limitation of the present invention. In general, the lighting device of the present invention includes a housing 1 defining an accommodation chamber 10, and a light-emitting module 2 mounted in the accommodation chamber 10, wherein the light-emitting module comprises a circuit board 21 carrying a plurality of light-emitting devices 22, a plurality of refracting prisms 23 adapted to refract a part of the light emitted by the light-emitting devices 22 horizontally toward two opposing sides through the light transmissive peripheral wall 121 of the top cover shell 12 of the housing 1, and two opposing double-beveled reflectors 24 adapted to reflect the other part of the light emitted by the light-emitting devices 22 toward the outside through the light transmissive peripheral wall 121 of the top cover shell 12 of the housing 1 in the same opposing directions. Thus, the invention extends the luminous range of the light-emitting devices 22, enhances the luminance and reduces light loss.

As stated above, the invention provides a lighting device, which has the following advantages and characteristics:

1. The use of the refracting prisms 23 and double-beveled reflectors 24 in the light-emitting module 2 enables the light emitted by the light-emitting diodes 22 of the light-emitting module 2 to be refracted and/or reflected toward the outside through the light transmissive peripheral wall 121 of the top cover shell 12 of the housing 1 in two opposing directions, thereby extending the luminous range of the light-emitting devices 22, enhancing the luminance and reducing light loss.

2. If the lighting device is used for indoor lighting, the number of lamps in every unit space can be relatively reduced while maintaining excellent luminance, saving lamp installation cost and power consumption.

3. The invention extends the luminous range of the light-emitting devices 22 and provides a long, rectangular luminous area, assuring high luminous brightness for indoor and outdoor applications.

Although a particular embodiment of the invention has been described in detail for purposes of illustration, various modifications and enhancements may be made without departing from the spirit and scope of the invention.

What the invention claimed is:

1. A lighting device, comprising:

a housing, said housing comprising an accommodation chamber and a light transmissive peripheral wall extending around said accommodation chamber; and a light-emitting module mounted in said accommodation chamber inside said housing, said light-emitting module comprising at least one light-emitting device controllable to emit light, at least one refracting means adapted to refract a part of the light emitted by said at least one light-emitting device horizontally toward two opposing sides through said light transmissive peripheral wall of said housing, and two opposing double-beveled reflectors arranged at two opposing sides relative to said at least one light-emitting device and said at least one refracting means and adapted to reflect the other part of the light emitted by said at least one light-emitting device toward the outside of said housing through said light transmissive peripheral wall in the same opposing directions.

2. The lighting device as claimed in claim 1, wherein said housing is configured subject to one of a group of shapes for signal light, desk lamp, searchlight, ceiling light and vehicle light.

3. The lighting device as claimed in claim 1, wherein said housing comprises a bottom shell and a top cover shell formed integral with a part of said bottom shell.

4. The lighting device as claimed in claim 1, wherein said housing comprises a bottom shell, a top cover shell and a mounting means adapted for fastening said top cover shell to said bottom shell, said mounting means being selected from the group of screw joint, snap joint, screws, rivets and pins.

5. The lighting device as claimed in claim 1, wherein said light transmissive peripheral wall of said housing is prepared from a material group consisting of transparent and translucent materials that have one of the gloss surface, semi-gloss surface, frosted surface, semi-frosted surface, fine sanded surface and multilayer surface structures.

6. The lighting device as claimed in claim 1, wherein each said light-emitting device is selected from the group of light-emitting diodes, organic light-emitting diodes, lamp bulbs and xenon bulbs.

7. The lighting device as claimed in claim 1, wherein said light-emitting module comprises a circuit board carrying a circuit layout and said at least one light-emitting device.

8. The lighting device as claimed in claim 1, wherein each said refracting means is a triangular refracting prism having a 10~45° angle included between two sides thereof through which the refracted beam passes.

9. The lighting device as claimed in claim 1, wherein said double-beveled reflectors are arranged at two opposing sides relative to said at least one light-emitting device and said at least one refracting means and aimed at each other, each said double-beveled reflector having a double-beveled structure formed of two vertically extending reflecting surfaces that meet at a vertex.

10. The lighting device as claimed in claim 9, wherein the two vertically extending reflecting surfaces of one said double-beveled reflectors define an included angle within the range of 100°~140°; the two vertically extending reflecting surfaces of the other said double-beveled reflectors define an included angle within the range of 40°~80°.

11. The lighting device as claimed in claim 9, wherein the two vertically extending reflecting surfaces of each said double-beveled reflectors define an included angle within the range of 100°~140°.

12. The lighting device as claimed in claim 9, wherein the two vertically extending reflecting surfaces of each said double-beveled reflectors define an included angle within the range of 40°~80°.

* * * * *